US007143456B2

(12) United States Patent
Woeste

(10) Patent No.: US 7,143,456 B2
(45) **Date of Patent: *Dec. 5, 2006**

(54) DEVICE FOR A SANITARY TUB, FOR PRODUCING AN AIR-WATER MASSAGE STREAM

(75) Inventor: Bernd Woeste, Ahlen (DE)

(73) Assignee: Franz Kaldewei GmbH & Co. KG, Ahlen (DE)

( * ) Notice: Subject to any disclaimer, the term of this patent is extended or adjusted under 35 U.S.C. 154(b) by 230 days.

This patent is subject to a terminal disclaimer.

(21) Appl. No.: 10/928,810

(22) Filed: Aug. 27, 2004

(65) Prior Publication Data

US 2005/0241060 A1 Nov. 3, 2005

(30) Foreign Application Priority Data

Apr. 30, 2004 (DE) ..... 10 2004 021 471

(51) Int. Cl.
*A61G 33/06* (2006.01)

(52) U.S. Cl. ..... 4/541.6; 4/541.5

(58) Field of Classification Search ..... 4/541.1–541.6
See application file for complete search history.

(56) References Cited

U.S. PATENT DOCUMENTS 5,056,168 A * 10/1991 Mersmann ..... 4/541.6
5,063,620 A * 11/1991 Mersmann ..... 4/541.6
5,335,376 A * 8/1994 Kaldewei ..... 4/541.6
6,065,161 A 5/2000 Mateina et al.
6,991,182 B1 * 1/2006 Chen ..... 239/251

FOREIGN PATENT DOCUMENTS

DE 198 34 341 2/2000

* cited by examiner

*Primary Examiner*—Charles E. Phillips
(74) *Attorney, Agent, or Firm*—Collard & Roe, P.C.

(57) ABSTRACT

A device for a sanitary tub, for producing a massage stream of air and water has an accommodation device that can be attached at an opening in the tub body of the sanitary tub, for accommodating an electric motor having a drive shaft. A propeller having a hub is attached to the drive shaft, and blades are arranged radially around the hub. A collar is arranged on the accommodation device, positioned within the sanitary tub, having edge-side inflow openings as well as a center outlet opening. The propeller draws in water located in the sanitary tub, through the inflow openings, and subsequently transports it back into the sanitary tub through the outlet opening. The accommodation device has a flow channel for feeding in air, which exits through the outlet opening, through an air channel arranged in the hub and with the stream of water transported by the propeller. Fan vanes for transporting air are arranged within the air channel of the hub.

8 Claims, 4 Drawing Sheets

Fig. 3a
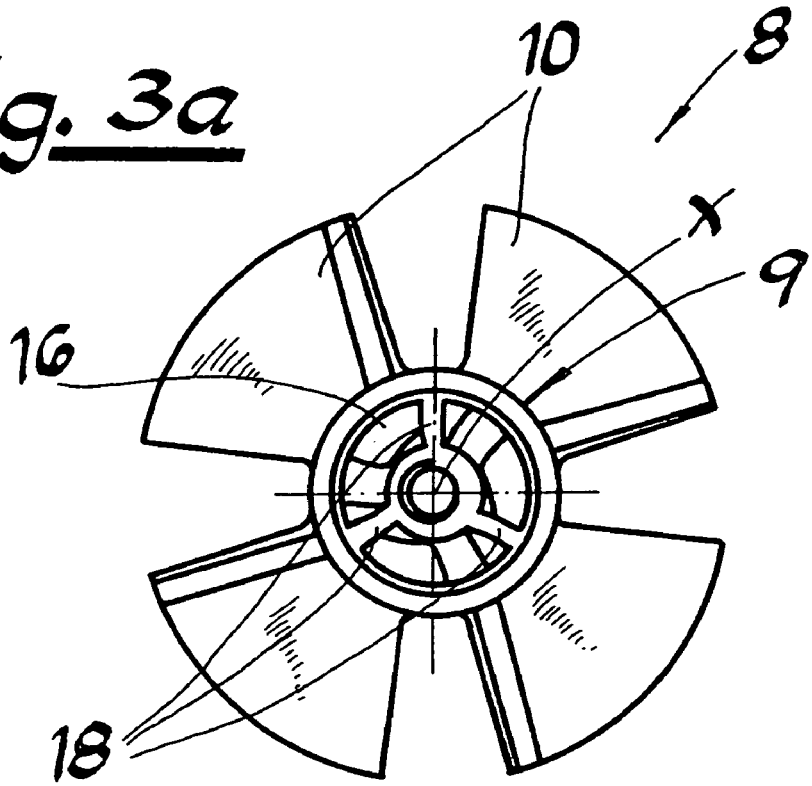
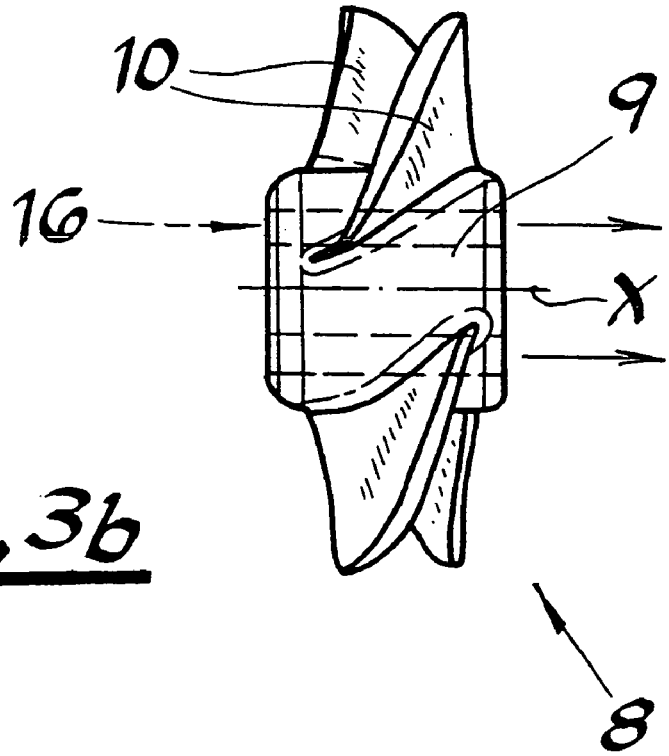
Fig. 3b

DEVICE FOR A SANITARY TUB, FOR PRODUCING AN AIR-WATER MASSAGE STREAM

BACKGROUND OF THE INVENTION

CROSS REFERENCE TO RELATED APPLICATIONS

Applicant claims priority under 35 U.S.C. §119 of German Application No. 10 2004 021 471.9 filed Apr. 30, 2004.

1. Field of the Invention

The present invention relates to a device for a sanitary tub, for producing a massage stream made up of air and water, having an accommodation device that can be attached at an opening in the tub body of the sanitary tub, for accommodating an electric motor having a drive shaft. A propeller having a hub is attached to the drive shaft, and blades are arranged radially around the hub. A rosette or collar is arranged on the accommodation device, positioned within the sanitary tub, having edge-side inflow openings as well as a center outlet opening. The propeller draws in water located in the sanitary tub, through the inflow openings, and subsequently transports it back into the sanitary tub through the outlet opening. The accommodation device has a flow channel for feeding in air, which exits through the outlet opening, through an air channel arranged in the hub and with the stream of water transported by the propeller.

2. The Prior Art

A device having the characteristics described initially is known from the document DE 198 34 341 C2. In the case of the known device, the drive shaft and the hub have an axial bore for feeding in the air stream. The supplied air stream mixes with the stream of water that is drawn in by way of inflow openings, within a bell-shaped guide element. A Venturi effect is used for drawing in the air stream. This effect results from an acceleration of the water by the propeller blades, and an accompanying locally reduced pressure in the region of the hub. Accordingly, the air feed is limited by the extent of the locally reduced pressure at the propeller hub.

SUMMARY OF THE INVENTION

It is an object of the present invention to provide a device having the characteristics described initially, but which exhibits an improved feed of ambient air.

This object is accomplished, according to the invention, by arranging fan vanes for transporting air within the air channel of the hub. According to the invention, the air channel functions as a fan which increases the air volume stream drawn in from the surroundings by the propeller rotation. The air channel is preferably ring-shaped and configured to be concentric to the hub axis. The ring-shaped configuration of the air channel allows a very fine distribution of the air drawn in, in the stream of water passed to the sanitary tub. Furthermore, the twist of the air stream that is produced by the fan vanes also contributes to intensive mixing of the air and water. Preferably, the propeller is structured as a one-piece injection-molded part made of plastic, which can be produced with little effort in terms of production technology.

A reflux preventer can be provided in front of the air inflow opening of the flow channel, to which an air inlet tap is connected upstream. The air feed can be optionally turned on and off by means of a valve.

According to a particularly preferred embodiment of the invention, a vane ring is arranged in the outlet opening. The vane ring can have an inner ring having a center passage opening, onto which the vanes are formed on the outside. It is practical if flow guide elements are arranged on the inside of the inner ring. These flow guide elements contribute to rectification or alignment of the flow as it passes through the passage opening. The vane ring can be arranged so it can pivot relative to the hub axis. In this way, it is possible to guide the air/water stream into a desired direction as it flows into the bathtub. It is practical if the vane ring has a ring-shaped bearing pan that forms a ball joint with a spherical surface segment arranged on the accommodation device. At the same time, the vane ring rests against the side of the rosette that faces the sanitary tub wall, at its edge. The pivot position can be changed by means of pressure on the vane ring. The vane ring remains in the desired position because of its elastic behavior.

BRIEF DESCRIPTION OF THE DRAWINGS

Other objects and features of the present invention will become apparent from the following detailed description considered in connection with the accompanying drawings. It should be understood, however, that the drawings are designed for the purpose of illustration only and not as a definition of the limits of the invention.

In the drawing, wherein similar reference characters denote similar elements throughout the several views:

FIGS. 3*a* and 3*b* are front and side views, respectively, of the propeller shown in FIGS. 1 and 2, and FIGS. 4*a* and 4*b* are front and side views, respectively, of the vane ring shown in FIG. 1.

DETAILED DESCRIPTION OF PREFERRED EMBODIMENTS

Figure 1:
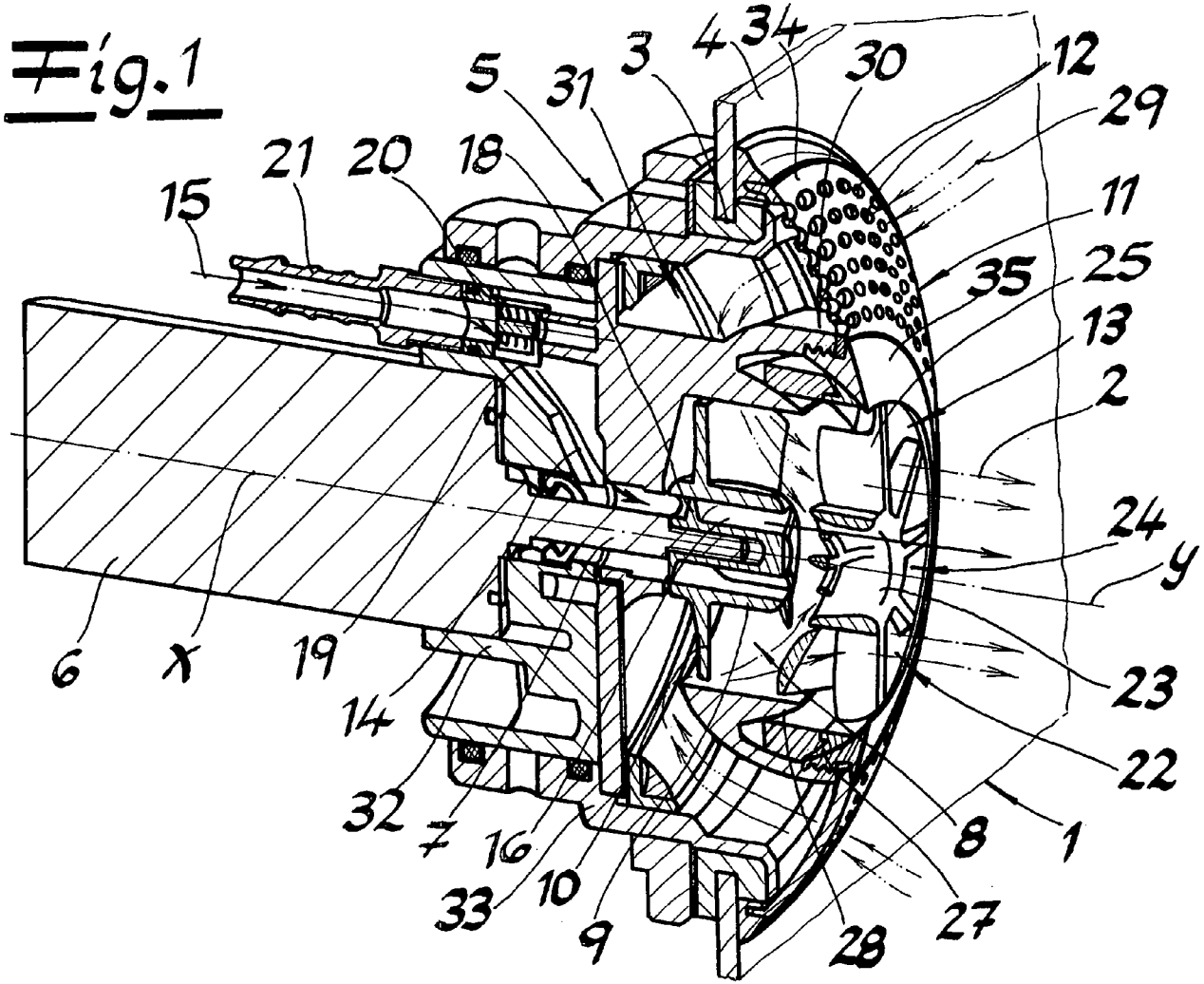
FIG. 1 is a three-dimensional cross-sectional view of a device according to the invention with a propeller and vane ring.
Figure 2:
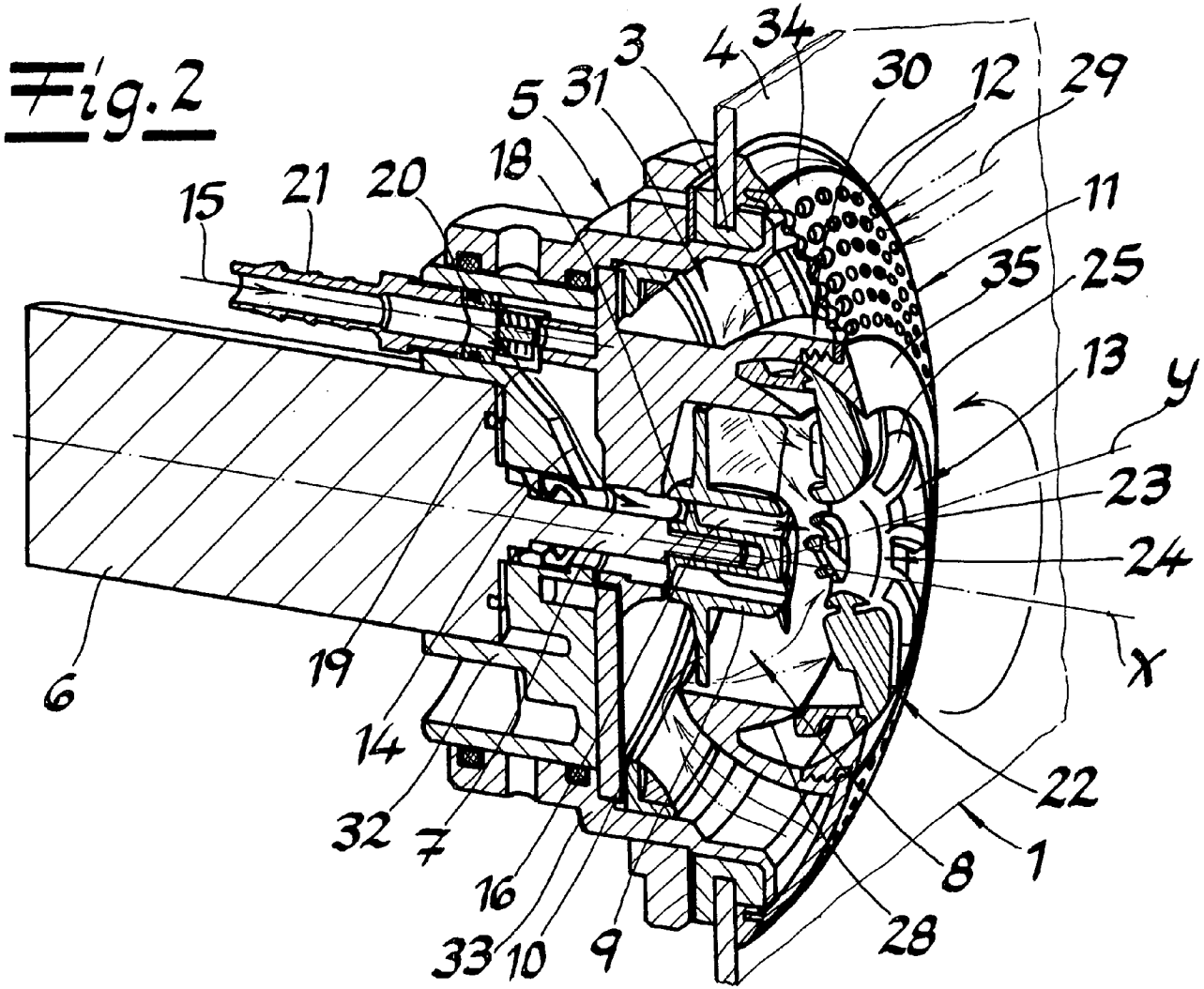
FIG. 2 shows the device according to FIG. 1, with the vane ring pivoted.

Referring now to the drawings, and in particular to FIGS. 1 and 2, a device is shown for a sanitary tub 1 for producing a massage stream 2 made up of water and air, having an accommodation device 5 that can be attached at an opening 3 in the tub body 4 of sanitary tub 1, for accommodating an electric motor 6 having a drive shaft 7. A propeller 8 having a hub 9 is attached to drive shaft 7, in overhung manner, and blades 10 are arranged radially around hub 9. A rosette or collar 11 is arranged on accommodation device 5, positioned within sanitary tub 1, having edge-side inflow openings 12 as well as a center outlet opening 13.

Collar 11 is configured in two parts and includes an outer ring 34 having the inflow openings 12, as well as an attachment ring 35 having outlet opening 13, which ring is connected with outer ring 34. Propeller 8 draws water located in sanitary tub 1 in through inflow openings 12, and subsequently transports the water back into sanitary tub 1 through outlet opening 13.

Accommodation device 5 has a flow channel 14 for feeding in air 15. The air exits through outlet opening 13 through an air channel 16 arranged in hub 9 and with the stream 29 of water that is transported by propeller 8. Accommodation device 5 is furthermore configured in multiple parts and has a motor holder 32 having flow channel 14, as well as an end plate 33 that is connected with the motor holder 32 and can be attached to the tub body 4. Fan vanes 18 for transporting air are arranged within the air channel 16 of hub 9. Accommodation device 5 furthermore includes a thread 30 for attaching the attachment ring 35 of collar 11, as well as a flow space 31 for guiding stream 29 of water that has been drawn in. Air channel 16 is ring-shaped and configured to be concentric to the hub axis X. In the exemplary embodiment, the propeller is configured as a one-piece injection-molded part made of plastic, which is screwed onto drive shaft 7. As is evident from FIGS. 1, 2, and 3*a*, vane-shaped ridges 18 are provided, which, at the same time, define the distance between the outer and the inner wall of air channel 16. Ridges 18 make a gradual transition into a purely axial orientation with a non-curved surface, in the flow direction. In front of the air inflow opening 19 of flow channel 14, a reflux preventer 20 is provided, to which an air inlet tap 21 is connected upstream. The air feed can be optionally turned on and off by a valve that is connected with an operating element, or by a separate rotating knob (not shown).

Figure 4A:
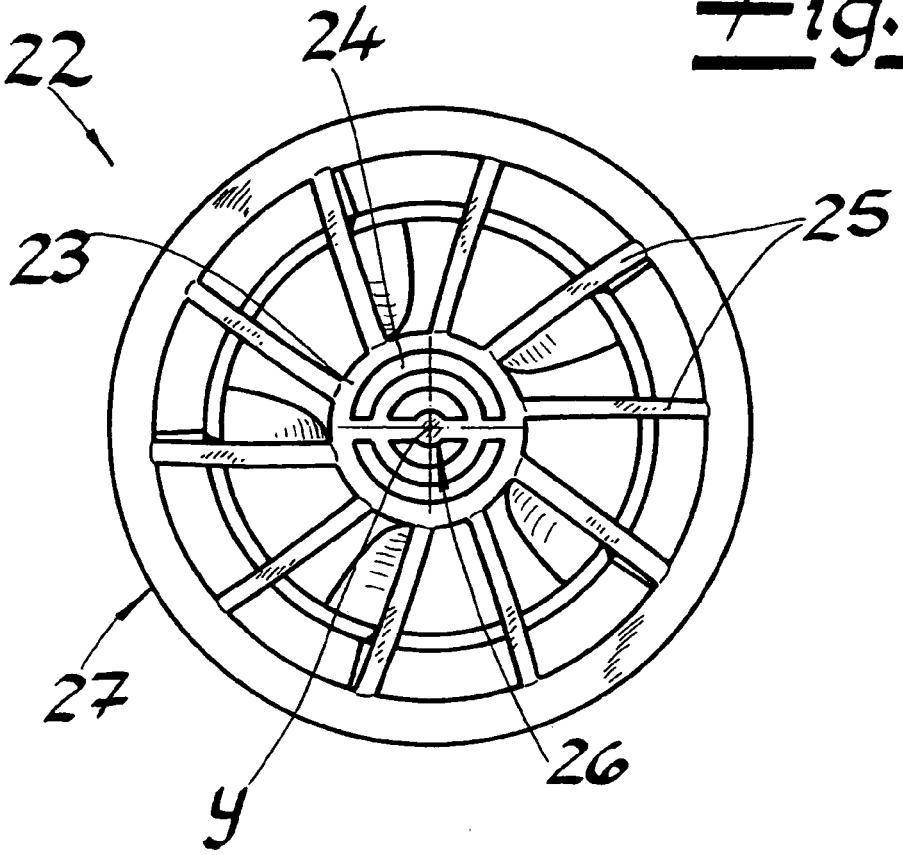
Figure 4B:
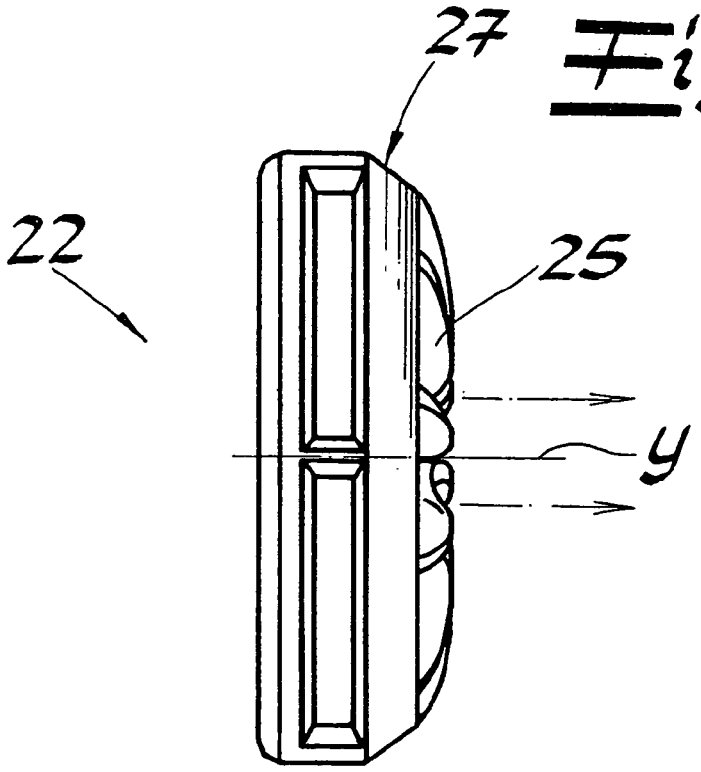

It is furthermore evident from FIGS. 1 and 2 that a vane ring 22 is arranged in outlet opening 13. Vane ring 22 has an inner ring 23 having a center passage opening 24, onto which the vanes 25 are formed on the outside (see FIG. 4*a*). On the inside of the inner ring 23, flow guide elements 26 are formed on, which guide the flow in passage opening 24 into a direction parallel to the axis Y of vane ring 22. A comparison of FIGS. 1 and 2 shows that vane ring 22 is arranged so that it can pivot relative to hub axis X. Vane ring 22 has a ring-shaped bearing pan 27 that forms a ball joint with a spherical surface segment 28 arranged on accommodation device 5 (see FIG. 4*b*). Bearing pan 27 is arranged on the outer end of vanes 25. At the same time, vane ring 22 rests against the side of the attachment ring 35 that faces the bathtub wall, at its edge. The pivot position can be changed by means of pressure on vane ring 22. Because of its elastic behavior, vane ring 22 remains in the desired position.

Although only a few embodiments of the present invention have been shown and described, it is to be understood that many changes and modifications may be made thereunto without departing from the spirit and scope of the invention as defined in the appended claims.

What is claimed is:

1. A device for a sanitary tub for producing an air-water massage stream comprising:

(a) an accommodation device adapted for attachment to an opening in the sanitary tub for accommodating an electric motor having a drive shaft;

(b) a propeller comprising a hub attached to said drive shaft and a plurality of blades arranged radially around said hub; and (c) a collar arranged on said accommodation device comprising edge-side inflow openings and a center outlet opening;

wherein said propeller is adapted to draw in a stream of water from within the sanitary tub through said inflow openings and to subsequently transport the water through said outlet opening back into the sanitary tub, said accommodation device having a flow channel for feeding in air which exits via an air channel arranged in said hub through said outlet opening with the stream of water transported by said propeller, wherein a plurality of fan vanes for transporting air are arranged within said air channel.

2. The device according to claim 1, wherein said hub has a hub axis and said air channel is ring-shaped and concentric with the hub axis.

3. The device according to claim 1, wherein said propeller comprises a one-piece plastic injection-molded part.

4. The device according to claim 1, wherein said flow channel has an air inflow opening and the device further comprises a reflux preventer provided in front of said air inflow opening, and an air inlet tap connected upstream to said air inflow opening.

5. The device according to claim 2, further comprising a vane ring arranged in said outlet opening.

6. The device according to claim 5, wherein said vane ring comprises an inner ring having a center passage opening and vanes formed outside said inner ring.

7. The device according to claim 6, further comprising flow guide elements arranged inside said inner ring.

8. The device according to claim 5, wherein said vane ring is arranged for pivoting relative to the hub axis.

* * * * *